US006562291B2

(12) United States Patent
Hinzpeter et al.

(10) Patent No.: US 6,562,291 B2
(45) Date of Patent: May 13, 2003

(54) PROCESS FOR THE MANUFACTURE OF COMPRESSED ARTICLES BY COMPACTING METALLIC POWDER AND SUBSEQUENTLY SINTERING THE COMPACT

(75) Inventors: Jürgen Hinzpeter, Schwarzenbek (DE); Ulrich Zeuschner, Schwarzenbek (DE); Thomas Pannewitz, Schwarzenbek (DE); Ulf Hauschild, Schwarzenbek (DE); Klaus Peter Rüssmann, Schwarzenbek (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 48 days.

(21) Appl. No.: 09/798,802

(22) Filed: Mar. 2, 2001

(65) Prior Publication Data

US 2001/0022944 A1 Sep. 20, 2001

(30) Foreign Application Priority Data

Mar. 4, 2000 (DE) ..... 100 10 671

(51) Int. Cl.[7] ..... B22F 3/00
(52) U.S. Cl. ..... 419/66; 419/14; 419/38
(58) Field of Search ..... 419/38, 14, 66

(56) References Cited

U.S. PATENT DOCUMENTS 4,695,414 A * 9/1987 Forslund et al.
5,547,360 A * 8/1996 Yokoyama ..... 425/149
6,074,584 A * 6/2000 Hinzpeter et al. ..... 264/40.5

FOREIGN PATENT DOCUMENTS

DE 39 19 821 12/1990
DE 42 09 08 767 5/1993
DE 197 17 217 12/1999

* cited by examiner

*Primary Examiner*—Ngoclan Mai
(74) *Attorney, Agent, or Firm*—Vidas, Arrett & Steinkraus, P.A.

(57) ABSTRACT

A process for the manufacture of compressed articles, particularly cemented-carbide cutting blade inserts, by compacting metallic powder and subsequently sintering the compact, particularly cemented-carbide reversible cutting blade inserts, which have a seating surface and at least one cutting edge extending approximately in parallel with the seating surface which is at a predetermined distance from the seating surface, by means of a press having a die-plate and a top ram and a bottom ram, comprising the steps of:

Charging a predetermined volume of metallic powder into the die-plate bore with the bottom ram taking a predetermined charging position in the die-plate bore, Displacing the bottom ram and the top ram to predetermined first and second positions, Displacing the bottom ram and, if need be, the top ram more while simultaneously measuring the compressive force at least for the bottom ram with the shift of the bottom ram or top ram being effected along a predetermined curve desired for the compressive force, Terminating the charging movement of the bottom ram and, if need be, the top ram when a predetermined value is reached for the compressive force.

5 Claims, 2 Drawing Sheets

PROCESS FOR THE MANUFACTURE OF COMPRESSED ARTICLES BY COMPACTING METALLIC POWDER AND SUBSEQUENTLY SINTERING THE COMPACT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The invention relates to a process for the manufacture of compressed articles, particularly cemented-carbide reversible cutting blade inserts, by compressing metallic powder and subsequently sintering the compact.

It is known to manufacture blanks from cemented carbide, ceramic material, sintered metal or the like by means of presses. The powdered or granular material requires to be provided in such a manner that the compact, when under an applied compacting pressure, assumes a homogeneous structure and allows itself to be sintered. A common forming operation is the so-called direct pressing process in appropriately designed die-sets or die-plates with which a top ram and a bottom ram are associated. In accordance with the respective compacting pressure, different densities will result for the compact. Lower-density compacts, however, will shrink more than higher-density compacts do during sintering. An attempt is made to minimize variations in density by means of differently adjustable compressing strokes for the top and bottom rams. On the other hand, in practice, varying densities may arise because of varying compressive forces which, in turn, are provoked, for example, by charging variations which may amount to some per cents with the compact heights being the same. A difficulty in manufacturing compacts, e.g. for cemented-carbide reversible cutting blade inserts, is that a predetermined overall height is maintained between the cutting blade insert seating and at least one cutting edge is of a predetermined distance from the cutting blade insert seating.

It has become known from DE 42 09 767 to achieve a density as uniform as possible within a batch, for example, by measuring the compressive force and subsequently making a correction via the charging volume for the compacts that succeed.

Further, it has become known from DE 197 17 217 to determine and store a desired force-stroke diagram (a desired curve), which is dependent on the geometry of the compact and the base material, for a compacting ram during compression. Using a separately operated portion of the compacting ram or a separate ram, the pressure acting on the material to be compressed is increased or decreased during compression as soon as a deviation from the desired curve is found to exist with a view to attaining the same density for each compact at the end of the compression phase. A procedure of this type, however, can only be applied to compacts in which the surface of the compact is uncritical in the medium range. For example, this applies to the seating surface in which it is sufficient, for example, for a circumferential edge to be at a precise distance from the cutting edge whereas the medium range may be more or less recessed.

It is the object of this invention to provide a process for the manufacture of cemented-carbide cutting blade inserts by compressing and sintering the compact, particularly cemented-carbide reversible carbide cutting blade inserts, which is simpler than the known, previously described process and, notwithstanding this, leads to excellent results.

BRIEF SUMMARY OF THE INVENTION

Like in the conventional process, the invention also provides for a predetermined volume of metallic powder to be charged into the die-plate bore with the bottom ram taking a charging position here. If required, the bottom ram is initially moved to a somewhat lower position so that a slight excess volume is charged, after which the bottom ram will take its final charging position and the remaining volume expelled from the die-plate bore will be stripped off by means of the charging shoe. Subsequently, the top ram and the bottom ram are moved to predetermined first and second positions, respectively, wherein a certain compressive force may be applied already. If it concerns a compact which is supposed to be used for a cutting blade insert with a clearance angle the location of the top ram, at the second position to which it is moved, corresponds to the upper edge of the compact, for example. Another shift of the bottom and top rams is effected subsequently, in which instance, however, only the bottom ram is displaced in case of a compact with a clearance angle. Compressive forces are continuously measured during this shifting operation where the infeed movement of the bottom and top rams is terminated once the compressive force has reached a predetermined value. Even if each of the two rams is displaced it may be sufficient to measure the compressive force on the bottom ram alone and to terminate the shifting motion once the compressive force has reached the predetermined value.

The value predetermined for the compressive force is determined by preceding trials. Initially, a determination is made as to which compaction the metallic powder is to undergo in order to be subjected to the sintering process afterwards. Then, an investigation is made on what the magnitude of the charging volume should be in order that a determined height of the compact be reproducibly achieved if a predetermined compressive force is applied. Therefore, if a turn-off is made once a predetermined compressive force is reached in the inventive process an assumption can be made that the predetermined height of the compact has been reached. In this way, a predetermined density of the compact is attained even in case of certain charging level variations exist. Since charging level variations cannot completely be precluded the preferred procedure is such that if tolerances exist there is a certain excess volume, when in doubt, if a turn-off is made at a predetermined compressive force value. In case of an excess volume, the compact is reduced in height, preferably by grinding, in order to bring it to the predetermined height or thickness.

According to an aspect of the invention, the shift of the bottom ram and/or the top ram from the first and second positions, respectively, is performed along a predetermined curve desired for the compressive force, which desired curve reflects the dependence of the compressive force on time. Thus, it becomes possible to approach the final compressive force values desired in a regulating way.

Although the compressive force is also measured in the known process, but while a predetermined position is moved to in order to vary the charging volume in case of compressive force deviations afterwards, the invention provides for a correction to be made directly on the compact.

The invention will now be explained in more detail with reference to drawings.

DETAILED DESCRIPTION OF THE INVENTION

Figure 1:
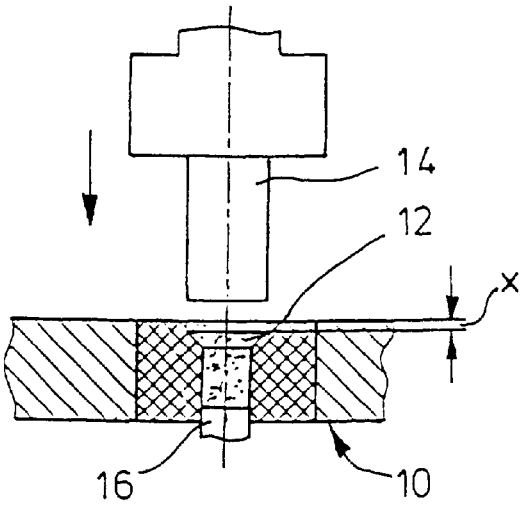
FIG. 1 shows a press to compress metallic powder according to the inventive process and the compressing operation proper.
Figure 2:
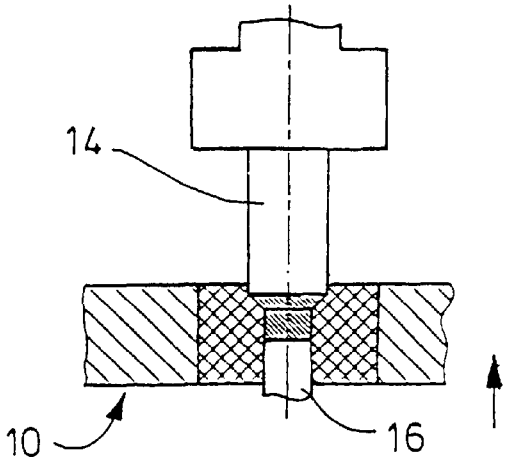
FIG. 2 shows the press of FIG. 1 during the compressing operation.

Referring to FIGS. 1 and 2, a die-plate 10 is shown the bore of which has a die cavity 12 which is conical in cross-section. Such a die cavity 12 makes it possible to produce a compact which is used as a cutting blade insert, e.g. a reversible cutting blade insert with a clearance angle. The upper edge of the die cavity 12 is at a distance x from the upper edge of the die-plate 10. A top ram 14 is disposed above the die-plate 10 and a bottom ram 16 is outlined below the die-plate 10. The rams 14, 16 are operated in an appropriate manner, preferably using hydraulic cylinders. These are controllable in a way (not shown) such as to apply a desired force. Moreover, they may be controlled in their speeds in order to generate a desired force-time curve, for example. When the die-plate bore is charged the bottom ram 16 is at a predetermined charging position. Its position will determine the charging volume. Preferably, it is somewhat lower than the theoretical charging position for the predetermined volume to allow the bottom ram to run upwards through a certain length after the charging operation in order that the charging shoe (not shown) may strip excess material from the upper surface of the die-plate. Subsequently, the top ram 14 and the bottom ram 16 are caused to move into the die-plate bore with the top ram 14 moving in to such an extent that it comes to lie at the upper surface of the die cavity 12. Thus, the depth to which it moves into the die-plate bore corresponds to the measure x. The bottom ram 16 is also displaced to a predetermined position as is approximately shown in FIG. 2. A compressing operation takes place already here.

Subsequently, the bottom ram 16 continues to be displaced until a predetermined compressive force has been reached. The compressive force is rated so that if there is a predetermined charging volume the height of the compact to be formed (not shown) corresponds to the desired height. If the desired height or desired thickness has not been reached yet it will be required, after sintering, to machine the cutting blade insert thus formed to the desired measure, e.g. by grinding. Therefore, care should be taken that the described process avoids forming a compact that has a measure smaller than specified.

Figure 3:
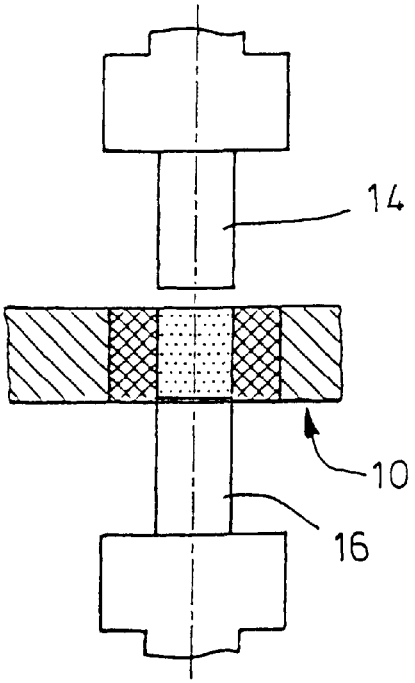
FIG. 3 shows a modified press to carry out the inventive process or the compressing operation.
Figure 4:
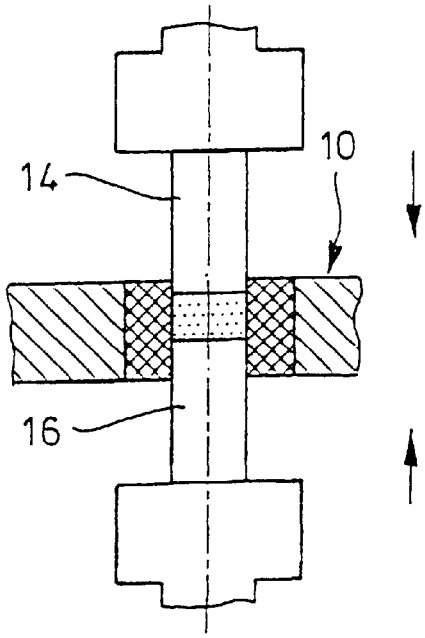
FIG. 4 shows the press of FIG. 3 during the compressing operation.

Instead of causing the bottom ram 16 to run to a predetermined maximum value of the compressive force a provision can be made to move it along a predetermined desired-value curve, i.e. a compressive force curve versus time, until the maximum compressive force value desired is reached. This helps to better achieve the desired reproducibility of the compressive force and the density of the compact. As is known one object is to achieve a reproducible density of the compact in order that reproducible geometrical dimensions may be obtained during the sintering process. The embodiment of FIGS. 3 and 4 is distinguished from the one of FIGS. 1 and 2 by the sole fact that the die-plate bore is cylindrical. Hence, the cutting blade insert produced by means of this process has no clearance angle. For the rest, the embodiment of FIGS. 3 and 4 is given the same reference numbers as the one of FIG. 1.

It can be appreciated from FIG. 4 that the compressive force may be applied by each of the two rams 14, 16. This also ensues from the diagram of FIG. 5.

Figure 5:
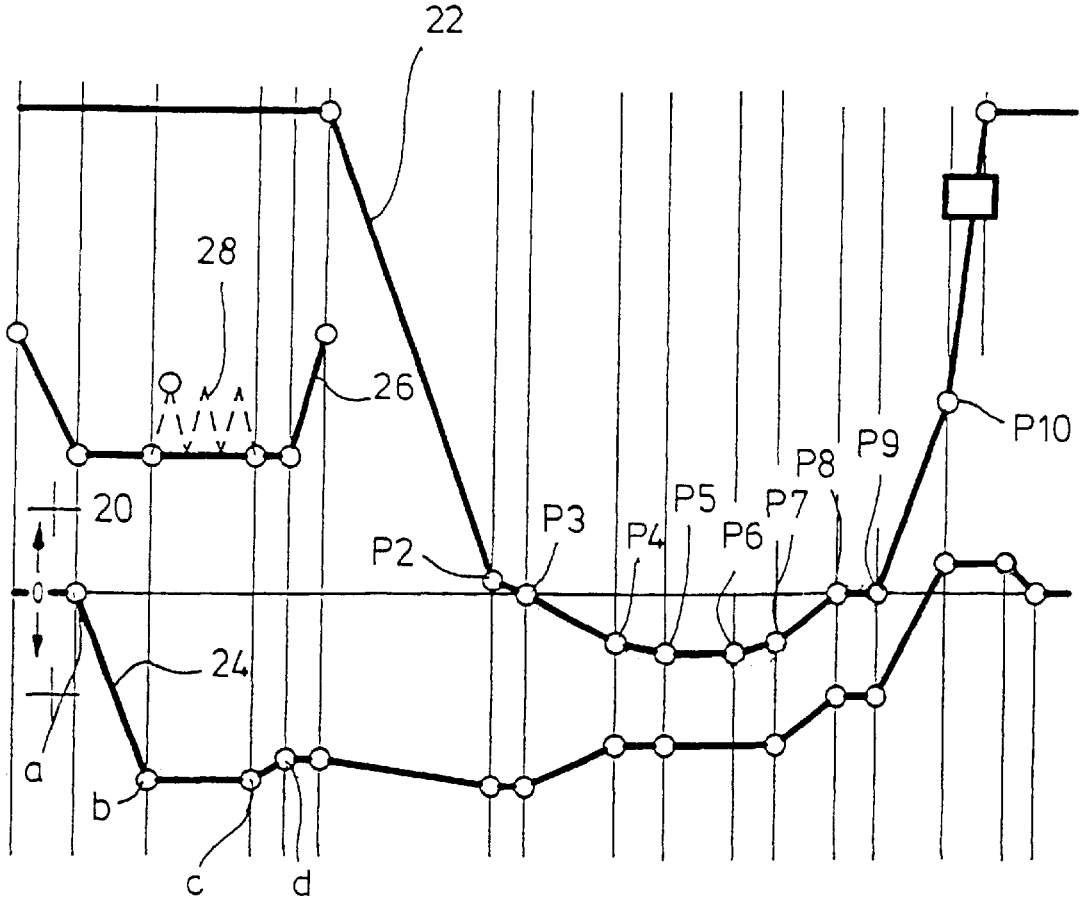
FIG. 5 shows a motion diagram for the compression rams of the press of FIGS. 3 and 4.

Line 20 of FIG. 5 outlines the upper edge of the die-plate. The bold-drawn curve 22 outlines the course of positions of a top ram, and the bold-drawn curve 24 outlines that of a bottom ram, e.g. the one of the rams 14, 16 of FIGS. 3 and 4. The bold-drawn line 26 outlines the course of positions of the charging shoe. At the beginning of the process, the bottom ram has taken the position a corresponding to the upper edge of the die-plate and the top ram clearly is above the upper edge of the die-plate. The charging shoe is above the die-plate and the bottom ram is displaced to a first charging position b during which the die-plate bore is filled with cemented-carbide metallic powder as is suggested at 28. Charging is completed at c. Subsequently, the bottom ram slightly moves up to position d which represents the final charging position, i.e. the column of powder in the die-plate corresponds to the predetermined charging volume. Any excessive material above the upper edge of the die-plate 20 will then be stripped off by the charging shoe. The charging shoe then moves to its initial position and the top ram moves to position P2 whilst the bottom ram slightly moves back again in order to prevent the top ram from laterally squeezing powdered material out of the die-plate bore. Subsequently, the top ram is displaced to position P3 with the bottom ram still maintaining the position taken before. Now, the compressing operation begins where position P4 of the top and bottom rams may be moved to via a predetermined path which is traveled by the rams. Suitable course transmitters make it possible to provide a precise course control for the rams. The powdered material here undergoes a more or less distinct compaction already. The compressive forces, e.g. those of the bottom ram, are continuously measured starting from position P4 onwards, during which operation the top ram and the and bottom ram continue to be moved towards each other as is shown in FIG. 4. It is presumed that a predetermined maximum compressive force will then be achieved in position P5. Likewise, it naturally is possible to adjust a predetermined maximum compressive force with regard to the top ram. This imparts a predetermined height or thickness to the compact at a desired compaction of the material. It is also possible to move from position P4 to P5 along a predetermined desired curve, i.e. according to a force-time diagram, until the desired final value has been reached for the compressive force. The compressive force is maintained between P5 and P6 with the top ram being slightly lifted after P6 to allow a certain stress relief of the compact. Subsequently, the top and bottom rams are moved up together until the top ram arrives at the upper edge of the die-plate 10. After some time (position 9), the top ram will be moved upwards, enabling the bottom ram to move the compact out of the die-plate bore.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A process for the manufacture of compressed articles, particularly cemented-carbide cutting blade inserts, by compacting metallic powder and subsequently sintering the compact, by means of a press having a die-plate with a die-bore, a top ram and a bottom ram, both rams cooperating with the die-bore, comprising the steps of:

charging a predetermined volume of the metallic powder into the die-bore, with the bottom ram taking a predetermined charging position within the die-bore, while the top ram is above the die-bore, displacing the top ram into the bore to a predetermined first position and displacing the bottom ram towards the top ram to a second position, displacing the bottom ram toward the top ram and simultaneously measuring the compressive force for the bottom ram with the shift of the bottom ram being effected along a predetermined curve desired for the compressive force, and terminating the movement of the bottom ram when a predetermined value for the compressive force is reached.

2. The process according to claim 1, further including the steps of:

displacing the top ram towards the bottom ram, and where the shift of the top ram towards the bottom ram is effected along a predetermined curve desired for the compressive force, and terminating the movement of the top ram when a predetermined value for the compressive force is reached.

3. A process for the manufacture of cemented-carbide cutting blade inserts having a seating surface and at least one cutting edge extending approximately in parallel with a seating surface which is at a predetermined distance from the seating surface, the cutting insert having no clearance angle, by means of a press having a die-plate with a die-bore, a top ram and a bottom ram, both rams cooperating with a die-bore, comprising the steps of:

charging a predetermined volume of the metallic powder into the die-bore, with the bottom ram taking a predetermined charging position within the die-bore, while the top ram is above the die-bore, displacing the top ram into the bore to a predetermined first position and displacing the bottom ram towards the top ram to a second position, displacing the bottom ram and the top ram towards each other and simultaneously measuring the compressive force at least of the bottom ram, and terminating the movement of the bottom ram when a predetermined value for the compressive force is reached.

4. The process of claim 3 further including the step of:

terminating the movement of the top ram when a predetermined value for the compressive force is reached.

5. A process for the manufacture of cemented-carbide cutting blade inserts having a seating surface and at least one cutting edge extending approximately in parallel with a seating surface which is at a predetermined distance from the seating surface, the cutting insert having a clearance angle, by means of a press having a die-plate with a die-bore, a top ram and a bottom ram, both rams cooperating with a die-bore, comprising the steps of:

charging a predetermined volume of the metallic powder into the die-bore, with the bottom ram taking a predetermined charging position within the die-bore, while the top ram is above the die-bore, displacing the top ram into the bore to a predetermined first position and displacing the bottom ram towards the top ram to a second position, displacing the bottom ram towards the top ram while holding the top ram in the first position and simultaneously measuring the compressive force for the bottom ram, and terminating the movement of the bottom ram when a predetermined value for the compressive force is reached.

* * * * *